US009185963B2

(12) United States Patent
Weeston

(10) Patent No.: US 9,185,963 B2
(45) Date of Patent: Nov. 17, 2015

(54) DEODORANT DISPENSING DEVICE AND RELATED METHODS

(71) Applicant: Jennifer Denise Weeston, San Diego, CA (US)

(72) Inventor: Jennifer Denise Weeston, San Diego, CA (US)

( * ) Notice: Subject to any disclaimer, the term of this patent is extended or adjusted under 35 U.S.C. 154(b) by 184 days.

(21) Appl. No.: 13/874,438

(22) Filed: Apr. 30, 2013

(65) Prior Publication Data

US 2014/0134123 A1 May 15, 2014

Related U.S. Application Data

(63) Continuation-in-part of application No. 29/437,231, filed on Nov. 14, 2012, now Pat. No. Des. 688,569.

(51) Int. Cl.

| | |
|---|---|
| ***B05C 1/00*** | (2006.01) |
| ***A45D 40/24*** | (2006.01) |
| ***A45D 40/04*** | (2006.01) |
| *A45D 40/18* | (2006.01) |

(52) U.S. Cl.
CPC ..... *A45D 40/24* (2013.01); *A45D 40/04* (2013.01); *A45D 40/18* (2013.01)

(58) Field of Classification Search
CPC ..... A45D 40/24; A45D 40/04; A45D 40/18
USPC ..... 401/17–19, 29, 31, 34, 75; 132/314
See application file for complete search history.

(56) References Cited

U.S. PATENT DOCUMENTS

| | | | | |
|---|---|---|---|---|
| 2,177,651 | A * | 10/1939 | Harris | 401/19 |
| 8,225,955 | B2 * | 7/2012 | Moskow et al. | 220/524 |
| 8,240,930 | B2 * | 8/2012 | Oshri | 401/19 |
| 2013/0344016 | A1 * | 12/2013 | Reed | 424/63 |
| 2014/0126948 | A1 * | 5/2014 | Haynes | 401/29 |

* cited by examiner

*Primary Examiner* — Jennifer C Chiang
(74) *Attorney, Agent, or Firm* — Buche & Associates, P.C.; John K. Buche

(57) ABSTRACT

A deodorant dispensing device and related method comprising a housing having two open ends, two cartridges contained within said housing wherein the two cartridges contain a solid or semi-solid deodorant, two caps removably attached to the two open ends of the housing, and a dual extension mechanism that controls the extension and retraction of the solid or semi-solid deodorant out of the two open ends of the housing. A preferable embodiment of the device employs open ends of the housing that are configured in axial alignment so that the two open ends extend in opposite directions. Another preferable embodiment of the device employs cartridges that are removably attached to the housing, disposable, and replaceable with replacement cartridges.

18 Claims, 6 Drawing Sheets

DEODORANT DISPENSING DEVICE AND RELATED METHODS

CROSS-REFERENCE TO RELATED APPLICATIONS

This application is a continuation in part of U.S. Des. patent application Ser. No. 29/437,231 (filed Nov. 14, 2012) entitled "Deodorant dispenser" and said application is hereby incorporated by reference in its entirety.

STATEMENT REGARDING FEDERALLY SPONSORED RESEARCH OR DEVELOPMENT

Not applicable.

BACKGROUND OF THE INVENTION

1. Field of Invention

The present disclosure generally relates to deodorant dispensing devices and related methods.

2. Background

The human underarm is one of the most consistently warm areas on the surface of the human body and therefore becomes moist due to the heat responsive activity of human sweat glands in an attempt to cool the area. Such moisture, known as perspiration, is predominantly odorless until it is fermented by bacteria. Fermented perspiration in the human underarm is common because bacteria thrive therein the frequently warm and moist environments. During fermentation, bacteria release waste products from its feeding off the perspiration, which is the principle cause of body odor. To avoid smelling bad as a result of underarm fermentation, humans have created deodorants and anti-perspirants (herein referred collectively as "deodorants") to prevent, mask, or eliminate such odor.

The origins of deodorant are thought to trace back to the medieval Islamic period of the $9^{th}$ century. Mum was an early (circa 1888) commercial cream deodorant that was initially packaged in a jar and applied by fingertips. Later, Mum was rebranded as Ban and applied using a roll-on applicator packaging that operated in a similar manner to a ball-point pen. Spray and aerosol dispensers have also been known for the packaging and application of deodorants. Now, "stick" deodorants are the most popular form of deodorant packaging and applicators used today.

Stick deodorants come in many shapes, sizes, and brands. Deodorant sticks range in strength from everyday use to sports-intensive, extra strength. Many times, consumers buy multiple sticks of deodorant to use for different purposes. For example, consumers often buy two sticks of deodorant, one for daily use and another for extra strength or "work out" use. Moreover, each brand of stick deodorant is available in numerous scents to appeal to the diverse preferences of different consumers. Consumers often buy multiple sticks of deodorant, each with a unique scent, in order to account for the consumer's daily preference, mood, or purpose. For instance, consumers often buy two or more sticks of deodorant, one tropical-themed scent for a summer themed event, one fruit-flavored scent for a user that enjoys fruit, and etcetera.

The simultaneous possession and use of multiple deodorant sticks for various application purposes and consumer preferences leads to inconvenience, waste, clutter, and expense. Multiple deodorant sticks take up valuable space in what may be very limited bathroom cabinet space. With every additional deodorant stick comes an additional plastic deodorant stick dispenser which leads to excess waste, unnecessary clutter, and increased expense. Furthermore, the excess waste has a negative impact on the environment. Finding the particular deodorant stick that the user is looking for can also become a time consuming task, leading to inconvenience.

There have been some notable attempts to address the problems of excess waste, unnecessary clutter, inconvenience, and expense associated with deodorant sticks. However, they have not taken the approach of the embodiments of the present application or are inadequate for a variety of reasons. For example, U.S. Pat. No. 6,196,421 to Williams teaches a double-ended dispenser, but this device focuses on aerosol sprays, which are no longer the basis for the most popular types of deodorants used today. Moreover, the double-ended aerosol spray design is awkward to use and creates liquid-flow problems since one side is inevitably stored upside down. U.S. Pat. No. 2,264,482 to Ridner teaches a double-ended cosmetic device, but does not contemplate dispensing multiple types of cosmetic substances from either end. Rather, the Ridner device dispenses a cosmetic substance on one end and employs a tool on the other. U.S. Pat. No. 6,276,853 to Breidenbach teaches a double-ended cosmetic device, but only contemplates dispensing liquids, similar to Williams above. This creates a need for additional, complicated parts to keep the liquid from leaking out of the device and therefore leads to increased cost.

While each of these attempts is noteworthy, current technologies fail to adequately address the common problems associated with the use of multiple deodorant sticks including excess waste, unnecessary clutter, inconvenience and expense. Many of the previous technologies are unlikely to be embraced by users by reason of awkwardness of use, cumbersome design, overly complicated mechanisms, or expensive retail prices as a result of the overly complicated mechanisms. Accordingly, there remains a need for means to dispense two types of deodorant sticks out of a single, simple, and cost-effective dispensing device.

SUMMARY OF THE INVENTION

In view of the foregoing, it is an object of the present application to provide dual-sided deodorant dispensing device.

It is another objective of the present application to provide a dual-sided deodorant dispensing device that is simple, inexpensive, and environmentally-friendly.

It is another objective of the present application to provide a dual-sided deodorant dispensing device comprised of disposable, environmentally-friendly materials.

It is yet another objective of the present application to provide a dual-sided deodorant dispensing device wherein two deodorant sticks are configured in axial alignment to extend in opposite directions.

It is yet still another objective of the present application to provide a dual-sided deodorant dispensing device with a dual extension mechanism that controls each deodorant stick individually.

It is another objective of the present application to provide a dual-sided deodorant dispensing device wherein the dual-sided deodorant dispensing device is comprised of two replaceable cartridges, each containing a particular type of deodorant stick.

It is yet another objective of the present application to provide a deodorant stick cartridge containing a particular type of deodorant stick that can be removably attached to either end of the dual-sided deodorant dispensing device.

It is another objective of the present application to provide a method of using the dual-sided deodorant dispensing device. In a preferable embodiment, the method comprises the steps of: removing a cap from one end of a dual-sided deodorant dispensing device; pressing an unlocking mechanism; removing a deodorant stick cartridge from the dual-sided deodorant dispensing device; obtaining a new deodorant stick cartridge; sliding the new deodorant stick cartridge into the dual-sided deodorant dispensing device; locking the new deodorant stick cartridge into the dual-sided deodorant dispensing device; replacing the cap onto the dual-sided deodorant dispensing device; and, repeating the process for the opposite end of the dual-sided deodorant dispensing device.

It is yet another objective of the present application to provide a method of using the dual-sided deodorant dispensing device. In a preferable embodiment, the method comprises the steps of: obtaining a container having two terminal ends, each containing deodorant, configured in axial alignment so that the two terminal ends project the deodorant to extend in opposite directions; choosing one of the two terminal ends containing deodorant to use; removing a cap from the chosen terminal end to expose the deodorant; activating a corresponding dispensing mechanism to extend the deodorant from said chosen terminal end of said container; and applying the deodorant to underarm(s).

Other objectives of the invention will become apparent to persons ordinarily skilled in the art once the invention has been shown and described. These objectives are not to be construed as limitations of Applicant's invention, but are merely aimed to suggest some of the many benefits that may be realized by the device and methods of the present application and with its many embodiments.

BRIEF DESCRIPTION OF THE FIGURES

The manner in which these objectives and other desirable characteristics can be obtained is better explained in the following description and attached figures in which.

It is to be noted, however, that the appended figures illustrate only typical embodiments disclosed in this application, and therefore, are not to be considered limiting of its scope, for the invention may admit to other equally effective embodiments that will be appreciated by persons ordinarily skilled in the arts. Also, figures are not necessarily made to scale.

DETAILED DESCRIPTION OF PREFERRED EMBODIMENTS

In general, disclosed is a dispenser wherein a typical deodorant dispensing device has been improved through the implementation of a second deodorant dispensing end, allowing for two types of deodorant to be contained and dispensed from a single, simple, inexpensive, environmentally-friendly device. In operation, a deodorant may be exposed from either end of the device for application. More specific aspects of a preferred embodiment of the dispenser are disclosed in connection with the figures.

Figure 1:
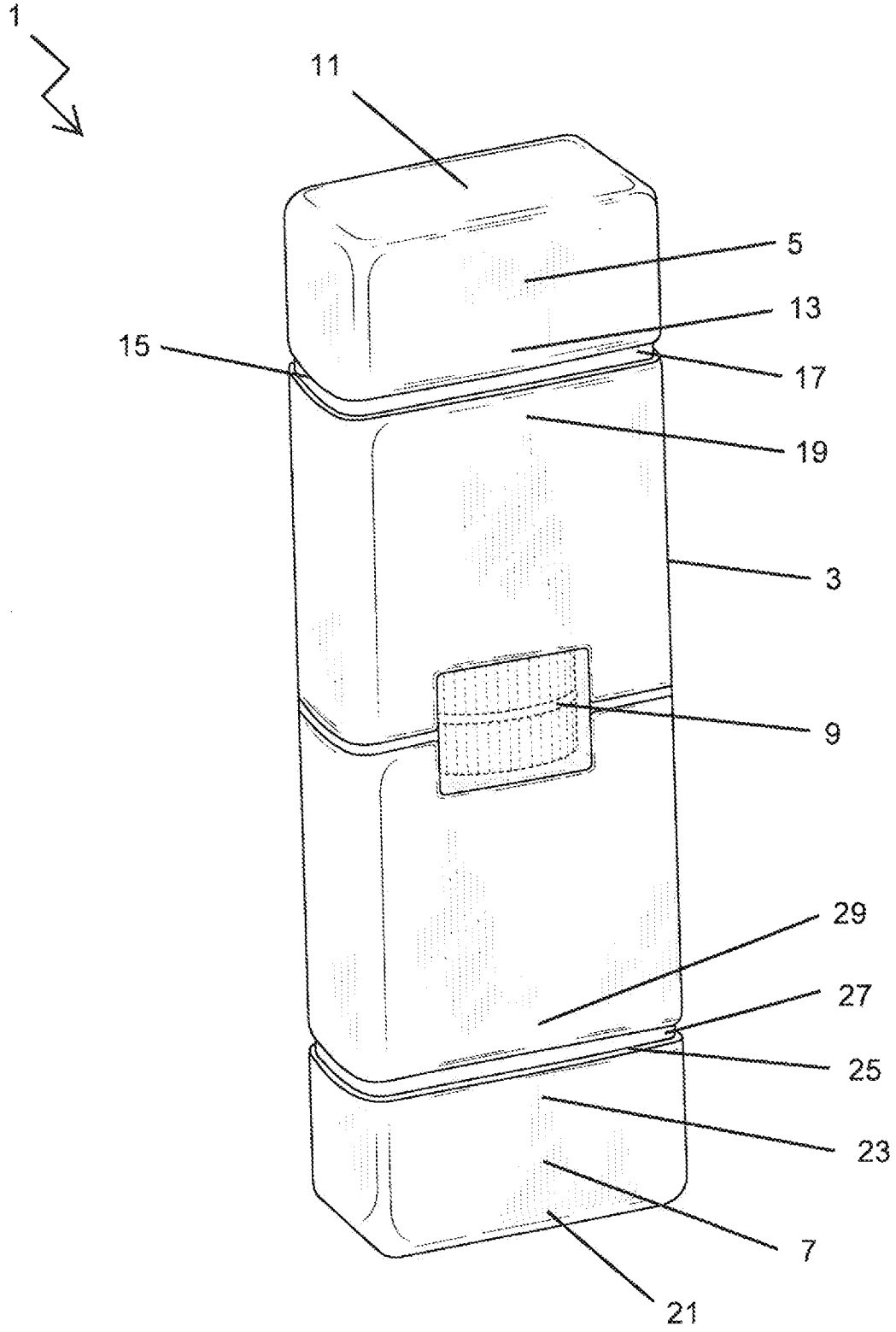
FIG. 1 is a perspective view of a deodorant dispenser.

FIG. 1 is a perspective view of a preferable embodiment of the dispenser disclosed in this specification (hereinafter "dual-sided deodorant dispensing device 1"). A dual-sided deodorant dispensing device 1 is comprised of a housing 3, a first cap 5, a second cap 7, and a dual extension mechanism 9. In a preferable embodiment of the present application, the housing 3, first cap 5, second cap 7, and dual extension mechanism 9 is comprised of environmentally-friendly materials such as biodegradable or easily recyclable polymers. The use of a single housing 3 for two deodorant sticks reduces clutter and inconvenience, while diminishing cost and the negative impact on the environment. The unique dual-sided deodorant dispensing device 1 design also provides an attractive avenue for marketing the present invention.

A preferable embodiment of the dual-sided deodorant dispensing device 1 contains two deodorant sticks that are configured in axial alignment to extend in opposite directions. The first cap 5 has a first closed end 11 and a first open end 13. The first cap 5 covers one deodorant stick by removably attaching to the housing 3 wherein the first cap 5 has a first female connector 15 on the outer rim of the first open end 13, and the housing 3 has a first male connector 17 on the outer rim of a first deodorant dispensing end 19. The second cap 7 has a second closed end 21 and a second open end 23. The second cap 7 covers the other deodorant stick by removably attaching to the housing 3 wherein the second cap 7 has a second female connector 25 on the outer rim of the second open end 23, and the housing 3 has a second male connector 27 on the outer rim of a second deodorant dispensing end 29.

The dual extension mechanism 9 is accessed through an open window in the housing 3. The dual extension mechanism 9 controls the distance that each deodorant stick protrudes from the housing 3 of the dual-sided deodorant dispensing device 1. The dual extension mechanism 9 can retract or extend the deodorant sticks and controls each deodorant stick individually.

Figure 2:
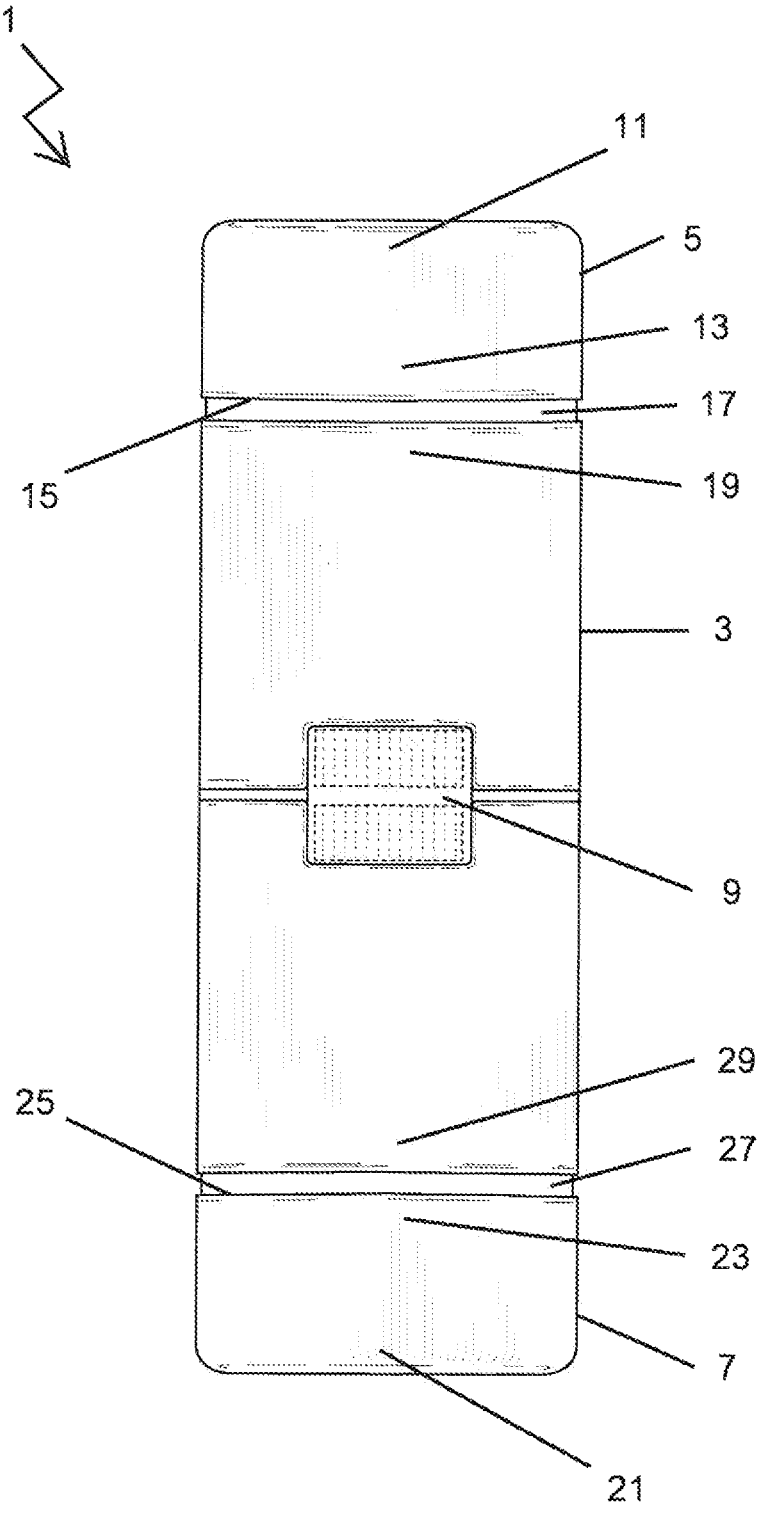
FIG. 2 is a back view of the deodorant dispenser of FIG. 1.
Figure 3:
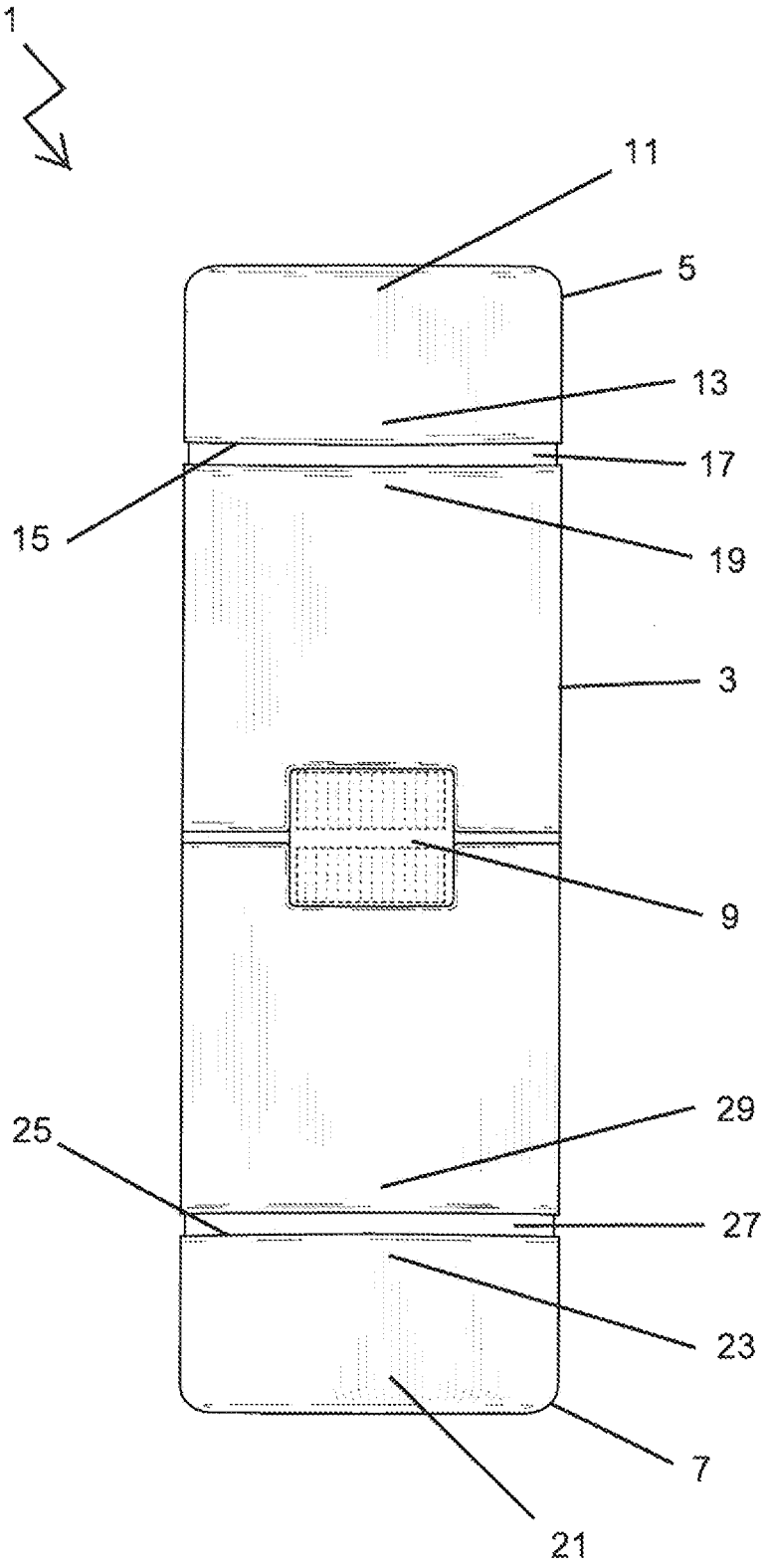
FIG. 3 is a front view of the deodorant dispenser of FIG. 1.
Figures 4, 5:
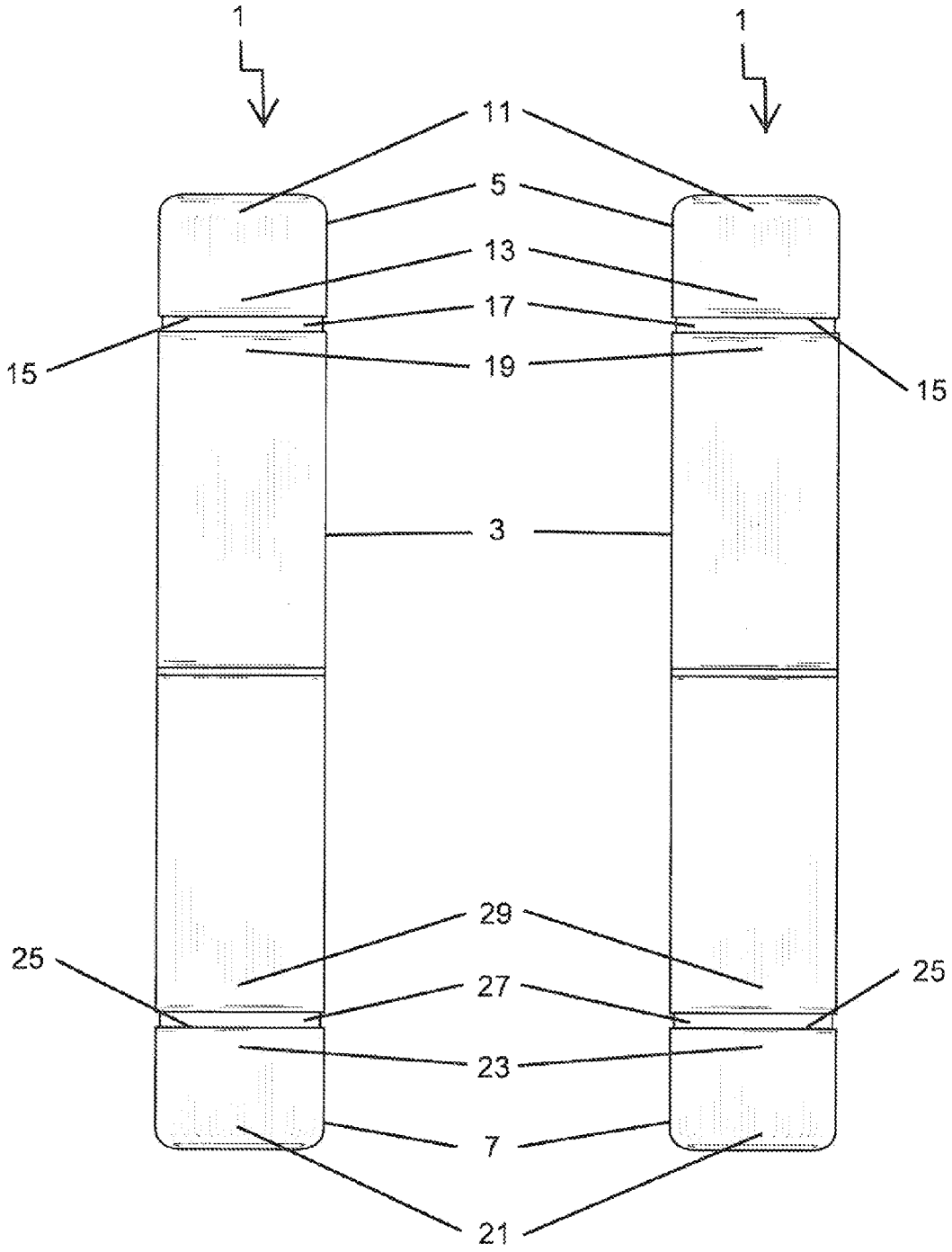
FIG. 4 is a left side view of the deodorant dispenser of FIG. 1.
FIG. 5 is a right side view of the deodorant dispenser of FIG. 1
Figure 6:
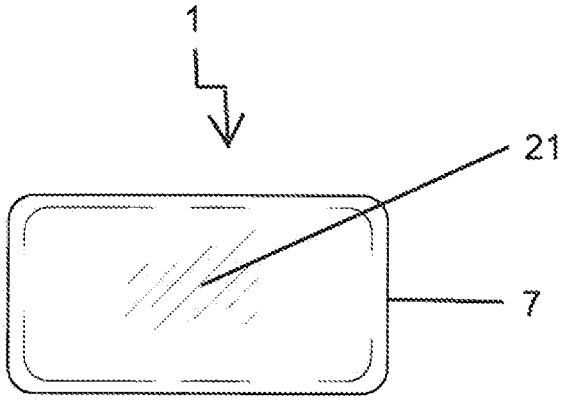
FIG. 6 is a bottom view of the deodorant dispenser of FIG. 1.
Figure 7:
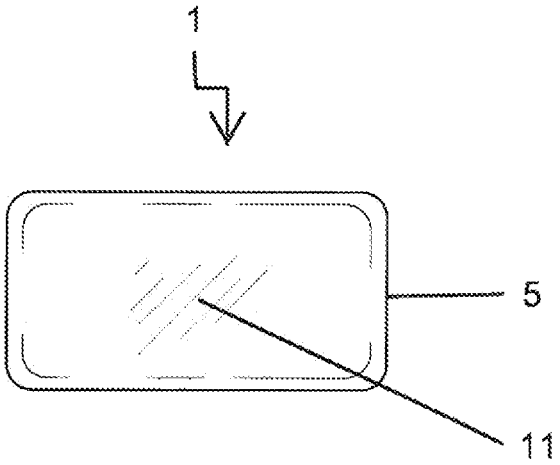
FIG. 7 is a top view of the deodorant dispenser of FIG. 1.

FIG. 2 is a back view of a preferable embodiment of a dual-sided deodorant dispensing device 1. FIG. 3 is a front view of said dual-sided deodorant dispensing device 1. FIG. 4 and FIG. 5 are left and right views, respectively, of said dual-sided deodorant dispensing device 1. FIG. 6 is a bottom view of said dual-sided deodorant dispensing device 1 showing the second closed end 21. FIG. 7 is a top view of said dual-sided deodorant dispensing device 1 showing the first closed end 11.

Figure 8:
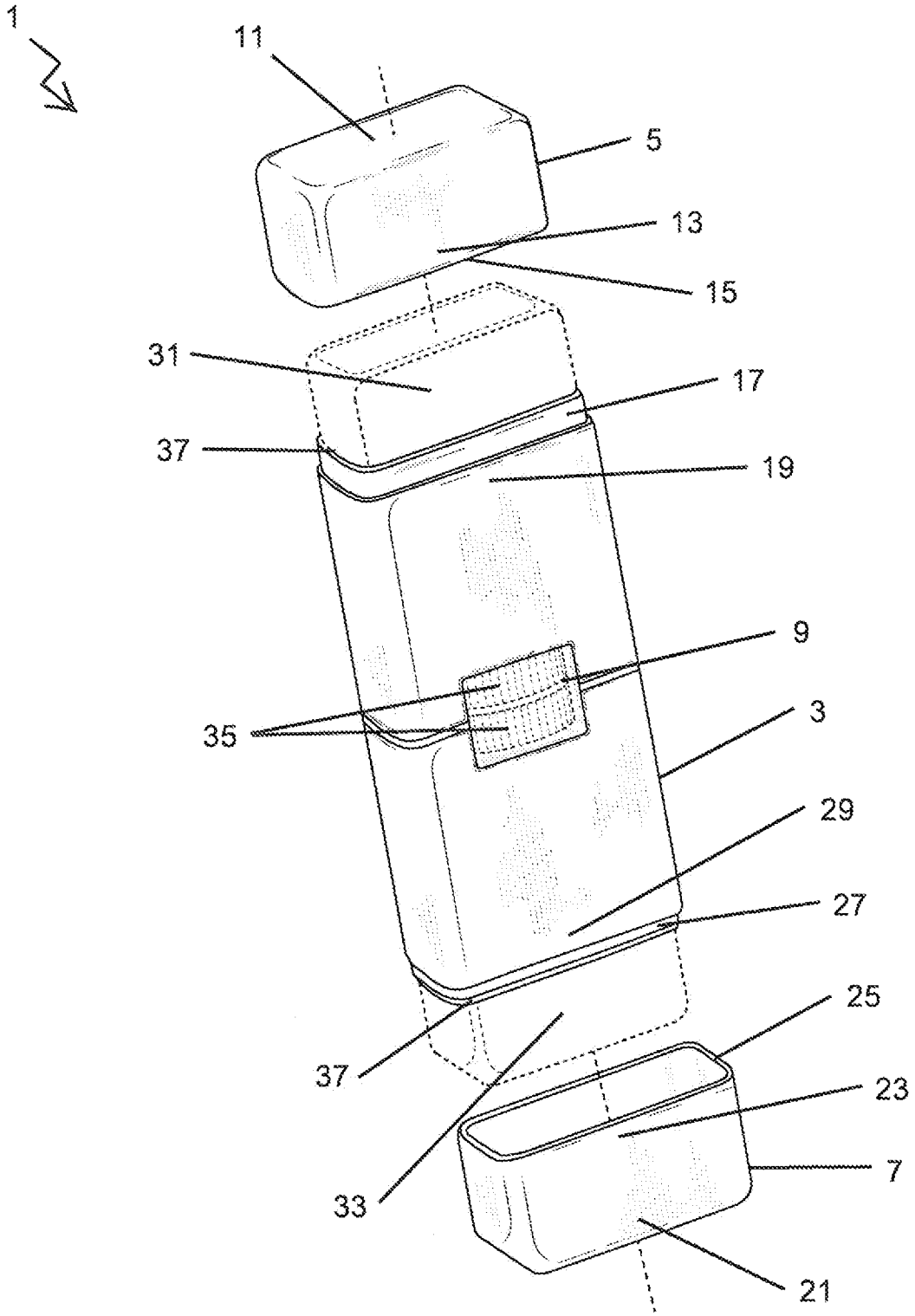
FIG. 8 is an environmental view of the deodorant dispenser of FIG. 1.

FIG. 8 is an environmental view of a preferable embodiment of the dual-sided deodorant dispensing device 1. This view features how the first cap 5 and the second cap 7 are removably attached to the housing 3. The first cap 5 covers a first deodorant stick 31 by removably attaching to the housing 3 wherein the first cap 5 has a first female connector 15 on the outer rim of the first open end 13, and the housing 3 has a first male connector 17 on the outer rim of a first deodorant dispensing end 19. The first deodorant stick 31 is housed within a cartridge 37. The second cap 7 covers a second deodorant stick 33 by removably attaching to the housing 3 wherein the second cap 7 has a second female connector 25 on the outer rim of the second open end 23, and the housing 3 has a second male connector 27 on the outer rim of a second deodorant dispensing end 29. Thee second deodorant stick 33 is housed within a cartridge 37. The drawing also illustrates how the dual-sided deodorant dispensing device 1 contains the first deodorant stick 31 and the second deodorant stick 33 that are configured in axial alignment to extend in opposite directions.

The dual extension mechanism 9 is accessed through an open window in the housing 3. The dual extension mechanism 9 controls the distance that each deodorant stick protrudes from the housing 3 of the dual-sided deodorant dispensing device 1. The dual extension mechanism 9 can retract or extend the deodorant sticks and controls each deodorant stick individually. In a preferable embodiment, the dual extension mechanism 9 is comprised of two control wheels 35. One control wheel 35 controls the extension and retraction of the first deodorant stick 31 by rotating the control wheel 35, while a second control wheel 35 controls the extension and retraction of the second deodorant stick 33 by the same mechanism.

In a preferable embodiment each individual deodorant stick (31 and 33) is housed within a replaceable cartridge 37. The replaceable cartridges 37 can contain a variety of different types and scents of deodorant sticks (31 and 33). The replaceable cartridges 37 can be removably attached to either end of the dual-sided deodorant dispensing device 1, replacing previous replaceable cartridges 37 and allowing for the preservation and reuse of the dual-sided deodorant dispensing device 1 housing 3. Reuse of the housing 3 leads to decreased cost and decreased waste. The replaceable cartridges 37 also provide another attractive avenue to market the present invention.

It should be noted that FIGS. 1 through 8 and the associated description are of illustrative importance only. In other words, the depiction and descriptions of the present invention should not be construed as limiting of the subject matter in this application. The device and methods discussed hereby are susceptible to modification without changing the overall concept of the disclosure, Additional modifications may become apparent to a person ordinarily skilled in the art after reading this disclosure.

The invention claimed is:

1. A deodorant dispensing device comprising:
- a housing having two terminal ends configured in axial alignment so that the two terminal ends extend in opposite directions and are operationally configured to contain deodorant;
- two caps that removably attach to the two terminal ends of the housing; and,
- a dual extension mechanism that controls the extension and retraction of a first solid or semi-solid deodarant from one of the terminal ends of the housing and a second solid or semi-solid deodorant from the other one of the terminal ends of the housing.

2. The device of claim 1 further comprising two cartridges wherein said cartridges are:
- contained within said housing;
- attached to said housing;
- contain a solid or semi-solid deodorant; and,
- configured for extension of the solid or semi-solid deodorant in opposite, axially-aligned directions.

3. The device of claim 2 wherein the housing, caps, cartridges, and dual extension mechanism are comprised of any of the group of materials consisting essentially of either:
- biodegradable polymer;
- recyclable polymer;
- glass; or,
- any combination thereof.

4. The device of claim 2 wherein the dual extension mechanism controls the extension and retraction of each solid or semi-solid deodorant individually.

5. The device of claim 4 wherein the dual extension mechanism is comprised of two control wheels where each control wheel can be individually rotated to control the extension and retraction of a corresponding solid or semi-solid deodorant from one open end of the housing.

6. The device of claim 2 wherein the two cartridges are:
- removably attached to the housing;
- disposable; and,
- replaceable with replacement cartridges.

7. A deodorant dispensing device comprising:
- a housing having two open ends;
- two cartridges contained within said housing wherein the two cartridges each contain a solid or semi-solid deodorant;
- two caps removably attached to the two open ends of the housing; and,
- a dual extension mechanism that controls the extension and retraction of the solid or semi-solid deodorant of one of the cartridges out of one of the open ends of the housing and the solid or semi-solid deodorant of the other one of the cartridges from the other one of the open ends.

8. The device of claim 7 wherein the open ends of said housing are configured in axial alignment so that the two open ends extend in opposite directions.

9. The device of claim 8 wherein the two caps employ female connectors that removably attach to male connectors on the open ends of the housing.

10. The device of claim 7 wherein the housing, caps, cartridges, and dual extension mechanism are comprised of any of the group of materials consisting essentially of either:
- biodegradable polymer;
- recyclable polymer;
- glass; or,
- any combination thereof.

11. The device of claim 8 wherein the dual extension mechanism controls the extension and retraction of each solid or semi-solid deodorant individually.

12. The device of claim 11 wherein the dual extension mechanism is comprised of two control wheels where each control wheel can be individually rotated to control the extension and retraction of a corresponding solid or semi-solid deodorant from one open end of the housing.

13. The device of claim 7 wherein the two cartridges are removably attached to the housing.

14. The device of claim 13 wherein the two cartridges are disposable and replaceable with replacement cartridges.

15. A method of grooming oneself to prevent noxious bodily odors comprising the steps:
- obtaining a container having two terminal ends, the first end containing a first deodorant and the second end containing a second deordorant, said ends configured in axial alignment so that the two terminal ends project the respective deodorants to extend or retract in opposite directions;
- choosing one of the two terminal ends containing the deodorants to use;
- removing a cap from the chosen terminal end to expose the associated deodorant from the chosen end;
- activating a corresponding dispensing mechanism to extend or retract the associated deodorant from said chosen terminal end of said container; and,
- applying the deodorant from the chosen end to underarm (s).

16. The method of claim 15 wherein the dispensing mechanism is comprised of dual control wheels that individually control the extension and retraction of the deodorant from each terminal end.

17. The method of claim 16 wherein the container, caps, and dispensing mechanism are comprised of any of the group of materials consisting essentially of either:

biodegradable polymer;

recyclable polymer;

glass; or, any combination thereof.

18. The method of claim 15 wherein the deodorant is contained in replaceable cartridges that are removably attached to each terminal end and can be replaced upon exhaustion of said deodorant.

* * * * *